United States Patent [19]

Koppelman

[11] 4,127,391

[45] * Nov. 28, 1978

[54] PROCESS FOR MAKING COKE FROM BITUMINOUS FINES AND FUELS PRODUCED THEREFROM

[76] Inventor: Edward Koppelman, 4424 Bergamo Dr., Encino, Calif. 91316

[ * ] Notice: The portion of the term of this patent subsequent to Oct. 4, 1994, has been disclaimed.

[21] Appl. No.: 831,342

[22] Filed: Sep. 7, 1977

Related U.S. Application Data

[63] Continuation-in-part of Ser. No. 648,170, Jan. 12, 1976, Pat. No. 4,052,168.

[51] Int. Cl.[2] ..... C10L 1/32; C10L 9/08; C10B 53/00

[52] U.S. Cl. ..... 44/51; 44/1 F; 44/33; 201/21

[58] Field of Search ..... 44/1 F, 33, 51; 201/21, 201/24, 25

[56] References Cited

U.S. PATENT DOCUMENTS

| | | | |
|---|---|---|---|
| 1,383,888 | 7/1921 | Wells | 201/25 |
| 1,601,501 | 9/1926 | Mallock | 201/21 X |
| 3,241,505 | 3/1966 | Long et al. | 44/51 X |
| 3,950,503 | 4/1976 | Spars | 44/1 F X |
| 4,052,168 | 10/1977 | Koppelman | 44/1 G |

*Primary Examiner*—Carl Dees

*Attorney, Agent, or Firm*—Harness, Dickey & Pierce

[57] ABSTRACT

A process for agglomerating bituminous fines into a useful low-sulfur particulated fuel by subjecting the bituminous fines to an autoclaving treatment at a controlled elevated temperature and controlled high pressure for a period of time sufficient to convert the moisture and a portion of the organic constituents therein to a gaseous phase and to effect a controlled thermal restructuring of the chemical structure thereof, providing a solid agglomerated coke-like product and a by-product fuel gas. It is further contemplated that the bituminous fines feed material can be subjected to a preliminary mechanical separation treatment to extract some of the impurities therein prior to the autoclaving step. It is further contemplated that the feed material can comprise bituminous fines blended with up to about 50% by weight of particulated cellulosic materials, such as agricultural and forest waste materials, which similarly are converted during the autoclaving treatment to a useful solid coke product.

21 Claims, 1 Drawing Figure

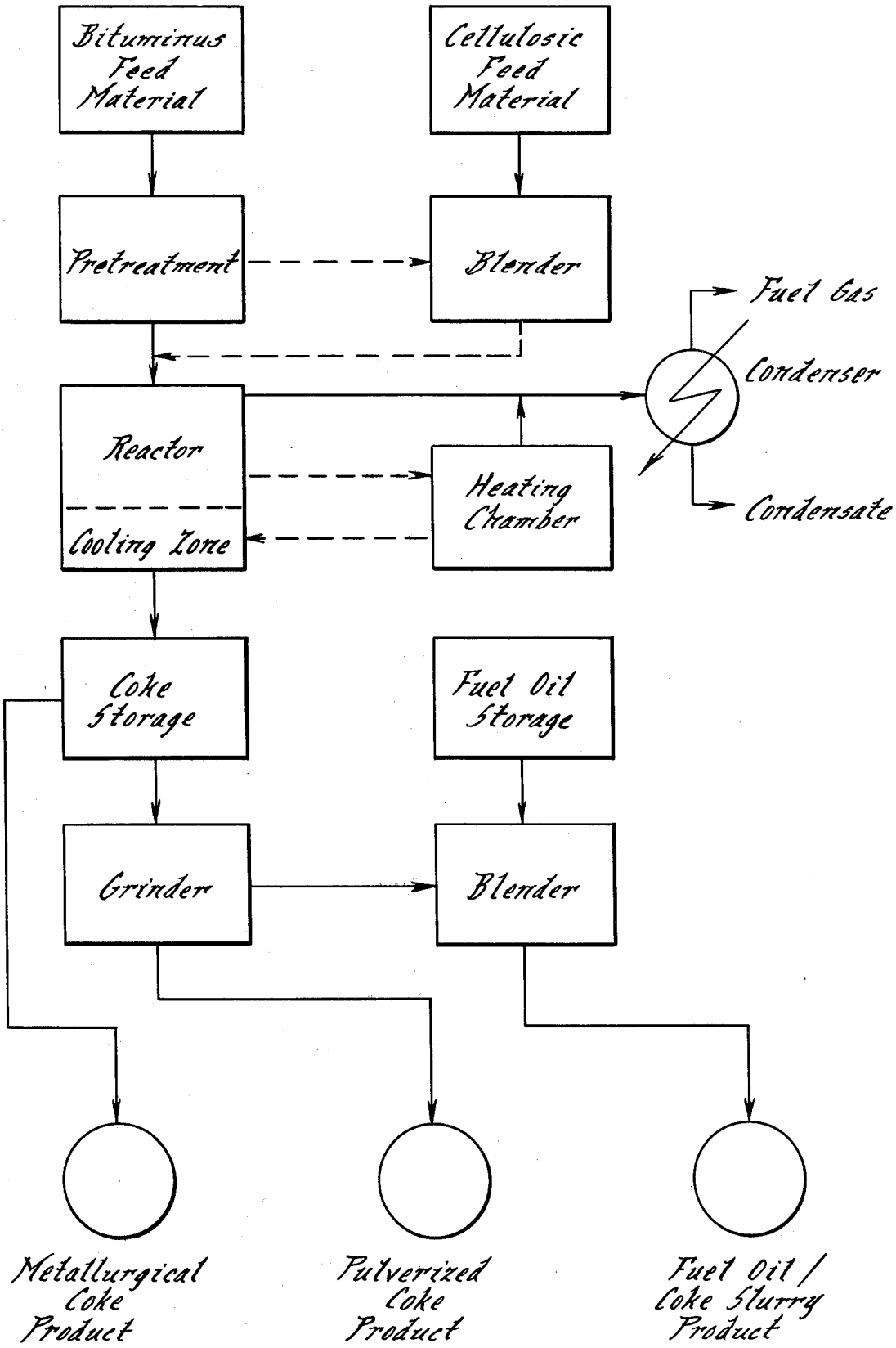
Bituminus Feed Material
Cellulosic Feed Material
Pretreatment
Blender
Fuel Gas
Condenser
Reactor
Heating Chamber
Cooling Zone
Condensate
Coke Storage
Fuel Oil Storage
Grinder
Blender
Metallurgical Coke Product
Pulverized Coke Product
Fuel Oil / Coke Slurry Product

PROCESS FOR MAKING COKE FROM BITUMINOUS FINES AND FUELS PRODUCED THEREFROM

REFERENCE TO RELATED APPLICATIONS

The present application is a continuation-in-part of U.S. application Ser. No. 648,170, filed Jan. 12, 1976, now U.S. Pat. No. 4,052,168, granted Oct. 4, 1977, for "Process for Upgrading Lignitic-Type Coal As A Fuel."

BACKGROUND OF THE INVENTION

In the aforementioned parent application Ser. No. 648,170, a process is disclosed for upgrading lignitic-type coals including brown coal, lignite and subbituminous coals, to render them more suitable as a solid fuel as a result of the thermal restructuring thereof, producing an upgraded carbonaceous product which is stable, resistant to weathering and of increased heating value, approaching that of bituminous coal. As a result of such process, vast domestic deposits of lignitic-type coal can be converted into a useful fuel and provide a potential solution to the present energy crisis.

In addition to the large domestic deposits of lignitic-type coals, large quantities of bituminous fines have been generated over the past 100 years as a result of coal processing and cleaning operations, which due to their fine size, cannot be satisfactorily employed as a fuel without further processing. Such bituminous fines waste materials are found in the form of tailings ponds and culm piles which have accumulated over the years as a result of coal washing and cleaning operations, as well as from the crushing of bituminous coals and the extraction of impurities therefrom by mechanical techniques such as flotation extraction operations, for example. The accumulated bituminous fines represent millions of tons of a potentially useful fuel and a potential source for high quality metallurgical coke.

Attempts heretofore to recover such bituminous fines and to agglomerate such fines into masses which are resistant to weathering and storage, and which can satisfactorily be burned in present-day steam power plants, has been unsatisfactory for a number of reasons, including the high cost of agglomerating such fines, and the cost of adequate agents required to bond the particles together into an integral mass.

In addition to such bituminous fines, large quantities of cellulosic type materials, both naturally occurring, such as peat, as well as various waste materials derived from lumbering and forestring operations and agricultural wastes, are generated each year which also are available in a form unsuitable for use as a commercial fuel. Such waste cellulosic materials, such as sawdust, bark, wood scraps and chips from lumbering operations, as well as various agricultural waste materials, such as cotton plant stalks, nutshells, corn husks, and the like, have heretofore represented a waste disposal problem. There has, accordingly, been a long-felt need for a process for recovering and converting such bituminous fines as well as such cellulosic materials into valuable products, thereby not only providing a potential solution to the fuel shortage and energy crisis, but also eliminating the expense in disposing of such waste materials.

In addition to the foregoing problems, Federal, state and local regulations, such as enacted by the Environmental Protection Agency, have imposed relatively stringent limitations on the quantity of sulfur in residential fuel oils that can be burned by public utilities for the generation of steam power and electricity. Current EPA regulations permit a maximum sulfur content per pound of heating oil of about 0.7%, whereas the state of California has imposed regulations limiting the sulfur content to a maximum level of about 0.3%. In order to comply with these regulations, it is customary in accordance with prior art practices to blend off domestic heating oils of relatively high sulfur content with low-sulfur heating oils imported from overseas in order to provide a residual blend having a sulfur content below the permissible limit. The premium cost of such foreign low-sulfur heating fuels makes this practice not only costly but also increases our reliance on foreign oil sources.

The foregoing problems are overcome in accordance with the present invention by providing a process whereby bituminous fines, alone or in combination with waste cellulosic materials, can be converted into a relatively low-sulfur and low-ash solid coke product useful as a high quality metallurgical coke or as a solid fuel by itself or, which upon further comminution, can be admixed with high sulfur heating oils, providing a residual liquid slurry blend of a sulfur content in compliance with regulatory requirements.

SUMMARY OF THE INVENTION

The benefits and advantages of the present invention are achieved by a process whereby a feed material comprising bituminous fines derived from coal processing operations or in further admixture with up to about 50% by weight of particulated cellulosic materials is charged into an autoclave in which the feed material is heated to an elevated temperature of at least about 750° F. and a pressure of at least about 1,000 psi for a controlled period of time to effect a conversion of the moisture and a portion of the organic constituents therein into a gaseous phase and a thermal restructuring of the feed material into a solid coke product. The gaseous phase formed in the autoclaving operation is withdrawn, and the noncondensible portion thereof provides for a by-product fuel gas which can be recovered for use in the process, with the surplus thereof sold. The solid coke product produced is cooled at the conclusion of the autoclaving step to a temperature at which it can be exposed to the atmosphere without combustion and can be further comminuted as may be desired to provide a particulated fuel. The condensible portion of the gaseous phase formed can be further processed as may be desired to recover the organic valuable constituents therein.

In accordance with a preferred embodiment of the present invention, the solid reaction product produced in the autoclave is subjected to a second elevated temperature of up to about 1800° F. for a period of time to further reduce the volatile constituents therein to a level less than about 1.5%, thereby producing a solid coke product of low volatile content.

In accordance with still a further embodiment of the present invention, the coke product produced, after cooling, is comminuted to a particle size less than about 48 mesh, and preferably of a particle size less than about 200 mesh, whereafter it is admixed with a high sulfur heating fuel in an amount ranging from as low as about 1% up to as high as about 50% by weight of the total mixture, producing thereby a liquid fuel oil slurry of reduced sulfur content.

Additional benefits and advantages of the present invention will become apparent upon a reading of the description of the preferred embodiments taken in conjunction with the drawing and the examples provided.

BRIEF DESCRIPTION OF THE DRAWING

The drawing comprises a schematic flow diagram of the process steps in accordance with the preferred embodiments of the present invention.

DESCRIPTION OF THE PREFERRED EMBODIMENTS

The sequence of steps employed in the process comprising the present invention is illustrated in the flow diagram comprising the drawing. As shown, a feed material comprising bituminous fines is introduced into a pretreatment stage in which the bituminous fines feed material is subjected to pulverizing, classification and/or further mechanical separation such as by flotation extraction to remove a portion of the contaminating constituents therein such as slag, pyrites, etc., to provide a resultant feed material of the desired purity and particle size. The bituminous feed material, after pretreatment, is thereafter charged into a high temperature and high pressure reactor in which it is subjected to heat under pressure to extract the moisture content and at least a portion of the volatile organic constituents therein and to further effect a thermal decomposition and controlled chemical restructuring of the chemical structure thereof. The gaseous by-products are withdrawn from the reactor and are introduced into a condenser in which the condensible phase is recovered as condensate, while the substantially noncondensible phase is recovered as a by-product fuel gas which can be advantageously recycled for use in the process and for the generation of supplemental power. The reaction product from the reactor passes from the reaction zone into a cooling zone in which it is cooled to a lower temperature at which it can be exposed to the atmosphere without incurring combustion or other adverse effects.

As shown in the flow diagram, the reaction or coke product is tranferred from the cooling zone to coke product storage. In accordance with one embodiment of the present invention, the coke product is transferred from coke storage to a grinding or comminution stage in which the coke is first pulverized to a desired size, rendering it suitable for use as a particulated solid fuel consistent with the particular type of furnace and burner design to be employed.

In accordance with a further embodiment of the present invention, all or a portion of the comminuted coke product can be transferred from the grinder to a blender in which it is admixed with a supply of fuel oil, forming a liquid slurry containing a controlled proportion of the particulated coke product suspended therein. The resultant fuel oil and coke slurry product is transferred from the blender to fuel oil coke slurry product storage.

In accordance with optional steps of the present invention, the bituminous feed material, with or without pretreatment, can be transferred in accordance with the dotted line as shown in the flow diagram, to a blender in which it is admixed with a controlled amount of a cellulosic feed material, including waste cellulosic materials derived from lumbering operations and agricultural waste. The resultant blended feed material is returned from the blender, as shown by the dotted line, to the inlet side of the reactor. In accordance with still a further optional step of the present invention, the reaction product prior to entering the cooling zone of the reactor is transferred to a heating chamber in accordance with the dotted line in which it is subjected to a second stage heating to an elevated temperature to effect a further reduction in the volatile content of the coke product. The volatile organic materials evolved are withdrawn from the heating chamber and transferred through the condenser for recovering the fuel gas constituents and liquid condensate product. After a prescribed heating period under high pressure or at a reduced pressure approaching atmospheric pressure, the coke product is transferred back to the cooling zone for cooling to a temperature at which it can be successfully transferred to coke storage and in exposure with air without incurring adverse effects.

As previously mentioned, the bituminous fines feed material is derived from any one of a variety of coal cleaning and washing operations of the types in current commercial practice for producing an upgraded coal product. Additionally, such bituminous fines were found in large quantities as sediment in tailings ponds or culm piles, which have accumulated over many years from prior coal washing and preparation operations and had been discarded as a waste material unsuitable for use as a solid fuel. Such bituminous fines recovered from filter presses from coal washing operations or from froth flotation extraction operations, as well as from tailings ponds, conventionally comprise a wet finely-particulated mass or mud in which the particles are of an average size generally less than about 28 mesh containing up to as high as about 30% by weight water. In accordance with the optional pretreatment step of the bituminous feed material, the material can be subjected to a pulverizing and/or classification or screening operation in which any agglomerates are broken down to provide a feed material of a desired particle size to facilitate its introduction to the reactor, as well as the optional blending thereof with a particulated cellulosic feed material. The particle size of the bituminous fines is not important in the practice of the present invention in that an agglomeration of the particles occurs during the reaction step. Similarly, the entrained water need not be removed inasmuch as the moisture content of the feed is substantially completely extracted during the reaction step and is withdrawn in both gaseous and liquid phases. In those instances in which the residual water content is relatively high, the pretreatment step may further include a removal of a portion of the water content to reduce that amount required to be extracted during the reaction step.

In those instances in which the bituminous fines feed material contain appreciable quantities of contaminating constituents, such as slate and sulfur bearing constituents such as pyrites and the like, it is further contemplated that the bituminous fines can be subjected to mechanical separation, such as a froth flotation treatment, to extract at least a portion of such contaminants, providing a higher purity feed material and a resultant higher purity coke product. Such mechanical or gravitational separation techniques are particularly desirable when the bituminous fines are derived from tailings ponds in which some contamination with sand and rock is occasioned during the recovery of the material.

In accordance with an optional feature of the process of the present invention, the bituminous fines feed material can be admixed with from about 1% to as high as about 50% by weight of a cellulosic feed material, forming a blend which in turn is charged to the reactor. The cellulosic feed material may comprise any one of a variety or mixtures of cellulosic materials, including naturally-occurring materials such as peat, as well as waste cellulosic materials, such as derived from lumbering and forestring operations and agricultural waste. Typically, such lumbering and saw mill waste materials may comprise sawdust, bark, wood scrap, branches and chips, while agricultural waste materials may comprise cotton plant stalks, nutshells, corn husks, and the like. Such waste materials ordinarily are subjected to a suitable shredding or comminuting operation, whereby the particle size thereof, depending on the nature of the cellulosic feed material, is reduced to a size less than about 12 mesh, and preferably to a particle size ranging from about 20 mesh to as low as about 40 mesh or smaller. The shredding or comminuting step may further include suitable classification or screening steps to separate any oversized particles for recycling through the comminuting step. The cellulosic feed material, prior to admixture with the bituminous fines feed material, may also be subjected to a preliminary drying treatment to reduce the residual moisture content therein to a level facilitating handling and blending, as well as to reduce the magnitude of moisture to be removed in the subsequent reaction steps.

In accordance with the flow diagram, the bituminous fines feed material, either alone or in admixture with a controlled amount of the particulated cellulosic feed material, is introduced into the inlet end of the reactor in which it is subjected to a temperature of at least about 750° F. and a pressure of at least about 1,000 psi for a controlled period of time to effect a controlled thermal restructuring of the chemical structure thereof, and to effect a conversion of the moisture and a portion of the volatile organic constituents therein, as well as the thermal decomposition products thereof, into a gaseous phase which is withdrawn from the reactor and passed through a condenser for separation and recovery of the condensible phase containing valuable chemical by-product constituents, such as benzene, phenol, cresylics, naphthalene, etc. The substantially noncondensible gaseous phase recovered in the condenser can advantageously be employed as a gaseous fuel for heating the reactor and for the generation of auxiliary power for operating the process, with the surplus thereof available for commercial sale.

While temperatures of at least about 750° F. are desirable during the autoclaving reaction, temperatures of about 1000° F. are preferred due to the increased rate of volatilization and thermal restructuring of the feed material to produce a higher fixed carbon value, thereby providing for reduced residence times in the autoclave and improved efficiency of operation. The temperature of the autoclaving reaction may range up to as high as about 1250° F., and temperatures above this level are usually undesirable because of too high a ratio of noncondensible gases to solid upgraded coke product. Particularly satisfactory results have been obtained employing temperatures ranging from about 1000° F. to about 1200° F., at pressures ranging from about 1,000 psi to about 3,000 psi. The maximum pressure usable may be as high as about 3,300 psi. Pressures generally above about 3,300 psi are undesirable due to the increased fabrication costs of pressure vessels capable of withstanding pressures of this magnitude and the absence of any appreciable benefits at such elevated pressures beyond those obtained at lower pressure levels of about 3,000 psi or lower.

The residence time of the feed material in the autoclave will vary depending upon the specific temperature-pressure-time relationship which is controlled within the parameters as hereinafter set forth to effect a substantially complete vaporization of the moisture content and volatilization of some of the volatile organic constituents, and a controlled thermal restructuring of the structure of the feed material.

During the autoclaving operation, a controlled degree of thermal restructuring and/or decomposition of the chemical structure also occurs, accompanied by the generation of additional gaseous components which also enter the gaseous phase. The thermal restructuring is not completely understood but is believed to consist of two or more simultaneous chemical reactions occurring between the reaction product and the gases present within the reactor. The net effect of these restructuring reactions are: (1) changes in the chemical characteristics results in an increase in the carbon-hydrogen ratio; (2) a reduction of sulfur due in part to the creation of a high partial pressure of hydrogen within the carbonaceous particles during the reaction which converts sulfur to hydrogen sulfide; (3) a reduction of nitrogen due in part to the creation of a high partial pressure of hydrogen within the carbonaceous particles during the reaction which converts nitrogen to ammonia; and (4) a reduction in the oxygen in the feed material by means of the elimination of carbon dioxide from the molecule.

The required residence time in the reactor decreases as the temperature and pressure in the autoclave, increases; while conversely, increased residence times are required when temperatures and pressures of lower magnitude are employed. Usually, residence times ranging from about 15 minutes up to about 1 hour, at temperatures ranging from about 900° F. to about 1200° F., under pressures of from about 1,000 psi to about 3,000 psi, are satisfactory. Advantageous results are also obtained with certain feed materials or blends of feed materials employing temperatures and pressures in the upper range of permissible levels utilizing residence times of as little as about 5 minutes, while residence times in excess of an hour can also be employed. Generally, the use of residence times in excess of about one hour do not provide appreciable benefits over those obtained employing residence times of from about 15 minutes to about 1 hour, and the resultant reduced through-put and efficiency of the process associated with such excessive residence times is undesirable from an economic standpoint.

The pressurization of the interior of the autoclave can be conveniently accomplished by controlling the quantity of feed material charged relative to the interior volume of the autoclave in consideration of the moisture content of the charge, such that upon heating thereof to the elevated temperature, the formation of the gaseous phase comprised of superheated steam and volatile organic matter effects a pressurization of the autoclave within the desired range. Supplemental pressurization of the autoclave can be achieved, if desired, by introducing a pressurized nonoxidizing or reducing gas into the autoclave, as well as pressurized steam.

At the conclusion of the autoclaving step, in accordance with one embodiment of the present invention, the autoclave is permitted to cool, either by air cooling or by the use of a cooling fluid, such as cooling water, for example, to a temperature below that at which the coke product can be exposed to air without adverse effects. Ordinarily, the cooling of the autoclave to a temperature below about 300° F. is adequate. A cooling of the autoclave to temperatures approaching 212° F. or below is generally undesirable because the condensation of the gaseous water phase which wets the coke product increasing its moisture content and correspondingly lowering its heating value.

The upgraded coke product is generally of a slate colored appearance and has a residual moisture content ranging from about 1% to about 5% by weight. Coke products derived from a feed material comprised essentially of bituminous fines are usually of a slate appearance, and contain a residual moisture content of from about 1% to about 5% by weight. A coke product derived from a mixture of bituminous fines and a cellulosic feed material present in about equal amounts is also typically characterized as being of a slate appearance and has a residual moisture content of from about 1% to about 5% by weight.

In accordance with a preferred embodiment of the process, at the completion of the autoclaving operation, the remaining high pressure within the autoclave is released at the autoclaving operating temperature and the hydrocarbon constituents recovered by condensation and the organic noncondensible gaseous constituents recovered as a by-product fuel gas. In this latter situation, only a small degree of deposition of the volatilized organic constituents is effected on the coke product. The coke product thus produced is nevertheless characterized as having a thermally transformed structure.

It is also contemplated that a two-stage autoclaving and coating operation can be performed, wherein the gaseous phase released from the autoclave while still at temperature is transferred to a second autoclave chamber in which the feed material to be processed is used as a cooling medium for condensing the tars and oils in the gaseous phase.

Referring again to the flow diagram, it is also contemplated that the coke reaction product can be transferred from the reactor to a heating chamber in which it is further heated to a temperature of from about 1250° F. to about 2000° F., and preferably from about 1500° F. to about 1900° F., for a period of time sufficient to further reduce the volatile constituents therein. The second stage heating step is particularly applicable when a metallurgical coke product is desired. The volatile constituents thus liberated are transferred along with the gaseous reaction phase from the reactor to the condenser for recovery of the condensible and noncondensible portions thereof. The heating of the coke reaction product in the heating chamber can conventionally be carried out for periods of time of from about 15 minutes up to about 1 hour or longer in order to remove the desired quantity of volatile constituents, and preferably to a volatile content of less than about 3% by weight. It will be understood that the heating of the coke reaction product to the second elevated temperature can be performed in a substantially nonoxidizing atmosphere under a pressure corresponding to that present in the reactor itself, and for this purpose, a separate heating section can be employed in the reactor to which the reaction product is transferred and from which it ultimately is conveyed to the cooling zone. Preferably, a separate heating chamber is employed to which the coke reaction product is transferred, and the pressure is released to provide a reduced pressure approaching that of atmospheric pressure. By employing a separate heating chamber, the size of the reactor can be correspondingly reduced, or alternatively, a greater throughput of feed material can be effected for a given volume reactor.

After the material has been heated in the heating chamber for a prescribed time period, it is transferred to a suitable cooling chamber, such as the cooling zone of the reactor, after which it is transferred to coke storage.

The cooled coke product is transferred from the cooling zone in accordance with the flow diagram to a coke storage from which it can be packaged and shipped in containers or bulk forms, or alternatively, can be further processed by subjecting it to suitable comminution or grinding to break up the agglomerates formed during the autoclaving operation, as well as to further comminute the product to the desired average particle size. The magnitude of comminution of the coke product will vary depending on its intended end use or the particular burner design to be employed for effecting combustion thereof as a particulated solid fuel. For example, if the coke product is to be employed in burner designs of the type utilized for the combustion of powdered coal and like fuels, particle sizes of less than about 48 mesh, and preferably less than about 200 mesh, are desired. Alternatively, if the coke product is to be employed in automatic furnace stoking equipment, larger particle sizes can be satisfactorily employed for such purpose.

The resultant coke product produced comprises a valuable solid heating fuel and can be directly employed in that form or in admixture with other conventional fuels. The coke product is characterized as having a relatively low sulfur content, usually less than about 4% by weight, and more usually, from about 2% to as low as about 0.06% by weight. When the coke product is derived from a mixture of cellulosic feed material and bituminous fines, the extremely low sulfur content of the cellulosic feed constituent provides for a resultant product having particularly low sulfur contents and low ash contents. Typically, the coke product has a heating value within the range of about 11,000 to about 15,000 BTU per pound.

Because of the low sulfur and ash contents of the coke product, it can advantageously be employed in admixture with other high sulfur fuels to produce a resultant fuel blend having a substantially lower average sulfur content and in conformance with permissible levels prescribed by EPA and other state and local regulations. While the comminuted coke product can advantageously be blended with particulated solid fuels, such as various bituminous and anthracite coals, particularly beneficial results are obtained when the comminuted coke product is blended with residual fuel oils to produce a liquid slurry containing as little as about 1% up to about 50% by weight coke product. The maximum amount of coke product incorporated in the liquid fuel is dictated in consideration of the increase in viscosity of the slurry as the concentration of the particulated coke is increased. Generally, the upper limit of coke concentration is that level at which a slurry of the necessary viscosity to enable pumping of the slurry is attained, and at which viscosity adequate fragmentation of the slurry is effected through the various types of commercial burner nozzles known. While slurry concentrations containing as little as about 1% by weight coke are contemplated, concentrations of such low level do not appreciably enhance the benefits attainable by the incorporation of the low-sulfur, low-sodium and low-ash coke products, and ordinarily concentrations of at least about 25% up to about 50% by weight are preferred. At concentration levels of about 50% by weight, the average sulfur content of the slurry blend is appreciably reduced in comparison to that present in the residual fuel oil employed, thereby enabling use of a variety of high sulfur fuel oils for producing acceptable fuel oil slurry blends which conform with EPA, state and local sulfur regulations.

It has been discovered that the mixture of the comminuted coke product at particle sizes of less than about 150 mesh (U.S. Sieve Size) and preferably less than about 200 mesh, results in a relatively stable slurry at concentrations as high as 50% coke and 50% fuel oil without the need of employing appreciable amounts of supplemental suspension agents to provide a stable slurry blend. Such supplemental suspension agents are usually employed in concentrations of from about 0.01% up to about 0.1% by weight of the total slurry and are comprised of any one of a variety of commercially available suspension agents, such as colloidal silica (Cab-O-Sil, available from Cabot Corp.) or the like.

In order to further illustrate the process of the present invention, the following specific examples are provided. It will be understood that the examples are provided for illustrative purposes and are not intended to be limiting of the scope of the invention as herein described and as set forth in the subjoined claims.

EXAMPLE 1

A charge comprising 80 grams of bituminum coal fines from Blue Creek No. 3 mine, Adger, Alabama, is placed in a test reactor. The feed material is in the form of particles of a size less than 28 mesh and contains about 19% by weight moisture.

The test reactor system consists of a cylindrical chamber comprised of stainless steel having an inner diameter of 1.25 inches and a length of 13.5 inches, providing a volume of 16.3 cubic inches. The reactor is provided with a conduit connected to a water-cooled condenser and a water displacement gas collector. A 5,000 psi pressure gauge is connected to the reactor for continuous pressure monitoring, and a Type K thermocouple is inserted into the well in the reactor system for continuous temperature monitoring. The system includes a conical point high pressure valve in the conduit between the reactor and gas condenser in order to bleed the gaseous phase from the reactor to maintain the desired pressure within the reaction chamber.

After the reactor is loaded and closed, it is placed in a horizontal position in a hot muffle furnace. After a period of 20 minutes, the reactor pressure is 1,500 psig and the temperature, as indicated by the thermocouple, is 863° F. At this point, the reactor valve is opened slightly and sufficient gas is released through the condenser system to maintain the pressure within the reactor substantially constant at 1,500 psig. During the next 25 minute period, or after a total of 55 minutes after the reactor was placed in the muffle furnace, the reactor temperature is 990° F., whereafter the reactor is removed from the furnace and the pressure is released to atmospheric pressure and the reactor is permitted to air cool.

A coke product comprising 60 grams is recovered, along with 1,200 cubic centimeters of a noncondensible combustible gas representing a total solids recovery of 75%. The solid coke product is characterized as being coke-like in appearance, having a hard honeycomb structure. The noncondensible fuel gas recovered burns with a yellow-tipped flame typical of bituminous coal gas containing illuminants.

A comparative analysis of the bituminous fines feed material and the coke product is set forth in the following table:

Feed and Product Analysis

| Analysis (Moisture-Free Basis) | Feed | Coke Product |
|---|---|---|
| Volatiles | 20.9 | 10.5 |
| Ash | 9.12 | 12.2 |
| Fixed Carbon | 70.0 | 77.3 |
| Sulfur | 0.70 | 0.74 |
| Heating Value (BTU/lb) | 14,280 | 13,361 |
| MAF* Heating Value (BTU/lb) | 15,700 | 15,420 |

*MAF - moisture and ash free

EXAMPLE 2

A charge comprising 60 grams of bituminum coal fines from Lower Kittanning bed in Pennsylvania is placed in a test reactor along with 40 grams of pinewood sawdust and 60 cc of water. The feed material is in the form of particles of a size less than 16 mesh.

The test reactor system is the same as that previously described in Example 1. After the reactor is loaded and closed, it is placed in a horizontal position in a hot muffle furnace. After a period of 8 minutes, the reactor pressure is 1,800 psig and the temperature, as indicated by the thermocouple, is 424° F. At this point, the reactor valve is opened slightly and sufficient gas is released through the condenser system to maintain the pressure within the reactor substantially constant at 1,600 psig. During the next 21 minute period, or after a total of 29 minutes after the reactor was placed in the muffle furnace, the reactor temperature is 998° F., whereafter the reactor is removed from the furnace, the pressure is reduced to atmospheric pressure and the reactor is permitted to air cool.

A pre-coke product comprising 61.2 grams is recovered, along with 17,750 cubic centimeters of a noncondensible combustible gas representing a total solids recovery of 61.2% on an as-charged basis. The solid pre-coke product is characterized as being coke-like in appearance, having a hard honeycomb structure and a dark grey color. The noncondensible fuel gas recovered burns with a blue flame.

A charge for a second stage heating comprising 34 grams of the pre-coke product is heated in the reactor at atmospheric pressure. After 31 minutes, the reactor temperature is 1813° F. and the reactor is allowed to remain at a temperature between 1800° F. and 1850° F. for an additional 52 minutes. The reactor is then removed from the furnace, allowed to cool to 200° F. and then opened. 31.94 grams of coke is produced along with 7,680 cc of combustible gas. The solid coke product is characterized as being coke-like in appearance, having a hard honeycomb structure and a slate-grey color.

A comparative analysis of the bituminous fines feed material, the pre-coke product and the coke product is set forth in the following table:

| Feed and Product Analysis | | | |
|---|---|---|---|
| Analysis (Moisture-Free Basis) | Feed | Pre-Coke Product | Coke Product |
| Volatiles | 22.3 | 5.7 | 2.1 |
| Ash | 9.6 | 9.9 | 12.8 |
| Fixed Carbon | 68.1 | 84.4 | 85.1 |
| Sulfur | 1.99 | 1.42 | 0.56 |
| Heating Value (BTU/lb) | 14,057 | 13,470 | 11,699 |
| MAF* Heating Value (BTU/lb) | 15,550 | 14,950 | 13,420 |

*MAF - moisture and ash free

In accordance with the results as set forth in the foregoing table, it is apparent that the sulfur content of the coke product relative to the initial bituminous fines feed material and to the pre-coke product has been reduced. The coke product is eminently suitable as a high-grade metallurgical coke or as a solid fuel.

EXAMPLE 3

An example of producing a metallurgical grade coke product from bituminous fines will now be described. A charge comprising 80.0 grams of bituminous coal fines from the Lower Kittanning seam in Pennsylvania is mixed with 30 cc water to form a paste and the mixture is placed in a test reactor similar to that employed in Examples 1 and 2. The coal fines is in the form of particles of a size less than 28 mesh and contains about 0.6% by weight moisture.

The condensate and gas collecting system consists of a first steam-cooled condenser, a second water-cooled condenser and a final 10 liter carboy in which the non-condensing gases are collected by displacement of a water solution of magnesium sulfate.

After the reactor is loaded and closed, it is placed in a hot muffle furnace. After a period of 7 minutes, the reactor pressure is 1,600 psi and the temperature, as indicated by the thermocouple, is 505° F. At this time, the reactor valve is opened slightly and sufficient gas is released through the condenser system to maintain the pressure within the reactor substantially constant at 1,600 psi. During the next 20 minute period, or after a total of 27 minutes after the reactor was placed in the muffle furnace, the reactor temperature is 1122° F., whereafter the reactor is removed from the furnace, the pressure is reduced to atmospheric, and the reactor is allowed to cool.

65.6 grams of coke product is recovered along with 16,500 cc of gas and 34 cc of condensed liquid which is predominantly water. The solid product is characterized as being coke-like is appearance, the color of dark slate and having a hard honeycomb structure. The collected gas burns with a yellow-tipped flame typical of bituminous coal gas containing illuminants.

33.7 grams of the solid product described in the preceding paragraph is placed in a stainless steel reactor having a volume of 17.8 cubic inches, a gas-tight cap, a gas outlet tube connected to a valve, and a thermowell containing a type K thermocouple. The reactor is closed and placed in a heated muffle furnace where it is brought to 1800° F. in 41 minutes, after which time it is maintained at about 1800° F. for an additional 95 minutes. The pressure in the reactor is maintained at substantially atmospheric during the entire time of the heating. Gas is produced during this treatment but is not measured or collected.

After a total heating period of 136 minutes, the reactor is removed from the furnace and is allowed to cool to 300° F. before being opened. 31.6 grams of coke product are recovered. The solid product is characterized as being slate-colored and coke-like in appearance, with a hard, honeycomb structure.

The compositions of the feed material, the intermediate coke product (made during the 1,600 psi—1100° F. treatment) and the final coke product (made during the 1800° F.-atmospheric treatment) are presented in the following table:

| Material | hz,1/32 Feed Material | Intermediate Coke Product | Final Coke Product |
|---|---|---|---|
| Moisture content (wt %) | 0.6 | 0.66 | 0.20 |
| Analysis (moisture-free basis - wt %) | | | |
| Volatiles | 22.3 | 5.45 | 1.0 |
| Ash | 9.6 | 12.2 | 15.2 |
| Fixed carbon | 68.1 | 82.4 | 83.8 |
| Higher heating value | 14,057 | 13,172 | 11,885 |
| C | 75.5 | 78.8 | 81.4 |
| H | 5.08 | 2.68 | 0.57 |
| N | 1.14 | 1.29 | 1.01 |
| O | 6.69 | 3.20 | 0.92 |
| Total sulfur | 1.99 | 1.86 | 0.90 |
| Sulfate sulfur | 0.18 | 0.13 | 0.07 |
| Pyretic sulfur | 1.28 | 0.11 | 0.01 |
| Organic sulfur | 0.53 | 1.62 | 0.73 |

In accordance with the results as set forth in the foregoing table, it is apparent that the total sulfur content of final coke product is less than half of the total sulfur content in the feed material. It is further apparent that the chemical form of the sulfur compounds is altered as a result of the first treatment in the reactor at 1,600 psi and 1122° F. so that the weight percent of organic sulfur is increased, while the weight percents of the pyretic sulfur, the sulfate sulfur and the total sulfur are decreased.

EXAMPLE 4

A portion of the coke product produced in accordance with Example 1 is grounded in a laboratory-sized ball mill and thereafter screened through a 200 mesh sieve. The mesh fraction greater than 200 mesh is reground for an additional period and rescreened. The less than 200 mesh fraction thereafter is blended with a Bunker C type fuel oil to form a stiff paste containing about 60% solids. Thereafter, additional fuel oil is added until the mixture contains about 52% solids. The resultant fuel oil slurry is agitated with a high shear agitator to provide for a substantially uniform suspension of the coke particles in the fuel oil.

In order to provide further stability to the fuel oil slurry, 0.05% by weight of a colloidal silica suspension agent is added during the high shear agitation of the slurry.

In the specific examples as hereinbefore provided, the autoclave comprises a laboratory scale model providing for a batch-type autoclaving of the feed material. It will be appreciated that autoclaves of any of the types known in the art capable of withstanding the elevated temperatures and pressures required in the practice of the process of the present invention can also be satisfactorily employed. It will also be understood that while the description as herein provided has been primarily directed to batch-type autoclaves, continuous autoclaves can also be employed for the practice of the process in which the feed material is continuously introduced into the inlet of the reactor through a suitable pressure lock-hopper or valve arrangement and the coke reaction product is continuously or intermittently extracted from the cooling zone of the reactor through a similar pressure lock-hopper or valve arrangement.

While it will be apparent the invention herein described is well calculated to achieve the benefits and advantages set forth above, it will be appreciated the invention is susceptible to modification, variation and change without departing from the spirit thereof.

What is claimed is:

1. A process for converting bituminous fines into a useful solid fuel which comprises the steps of charging a feed material comprising bituminous fines into an autoclave, heating said feed material to an elevated temperature of at least about 750° F. up to about 1250° F. and pressure of at least about 1000 psi for a period of time sufficient to convert any moisture present and at least a portion of the volatile organic constituents therein into a gaseous phase and to effect a partial thermal restructuring of the chemical structure thereof and a change in its chemical composition to produce an agglomerated solid reaction product, and thereafter cooling said reaction product and recovering the upgraded solid coke product.

2. The process as defined in claim 1, in which the step of heating said feed material in said autoclave is conducted at a temperature ranging from about 900° F. to about 1250° F.

3. The process as defined in claim 1, in which the step of heating said feed material in said autoclave is conducted at a temperature ranging from about 1000° F. to about 1200° F.

4. The process as defined in claim 1, in which the step of heating said feed material in said autoclave is conducted at a pressure of at least about 1,000 psi to about 3,300 psi.

5. The process as defined in claim 1, in which the step of heating said feed material in said autoclave is conducted at a pressure of about 1,000 psi to about 3,000 psi.

6. The process as defined in claim 1, including the further step of recovering the gaseous phase from said autoclave, extracting at least a portion of the condensible constituents in said gaseous phase and recovering the condensible portion and the noncondensible gaseous portion.

7. The process as defined in claim 1, including the further step of comminuting the recovered solid cake product to a desired particle size.

8. The process as defined in claim 1, including the further steps of heating the solid reaction product at the completion of the autoclaving step and prior to the cooling step to a second elevated temperature of from about 1250° F. to about 2000° F. for a period of time sufficient to effect a further conversion of volatile organic constituents therein to the gaseous phase to reduce the volatile content of said coke product.

9. The process as defined in claim 8, in which the step of heating said solid reaction product to said second elevated temperature is performed for a period of time sufficient to reduce the volatile content of said solid coke product to a level below about 3%.

10. The process as defined in claim 8, including the further step of reducing the pressure on said reaction product prior to heating said reaction product to said second elevated temperature.

11. The process as defined in claim 10, in which the further step of reducing the pressure on said reaction product is performed to provide a pressure of about atmospheric pressure.

12. The process as defined in claim 10, in which the further step of reducing said pressure on said reaction product is performed by transferring said reaction product from the autoclave to a second heating chamber under a reduced pressure in which said reaction product is heated to said second elevated temperature prior to cooling.

13. The process as defined in claim 1, including the further step of treating said feed material to extract a portion of the contaminating constituents therein prior to charging to said autoclave.

14. The process as defined in claim 1, including the further step of admixing a particulated cellulosic material with the bituminous fines to produce a blended feed material.

15. The process as defined in claim 14, in which the further step of admixing a particulated cellulosic material is performed to provide a concentration of cellulosic material in said feed material at a concentration of up to about 50% by weight of the total blended said feed material.

16. The process as defined in claim 14, including the further step of comminuting the cellulosic material to an average particle size of less than about 12 mesh prior to admixture with the bituminous fines.

17. The process as defined in claim 14, in which said cellulosic material is selected from the group consisting of peat, agricultural waste materials, forest and lumbering waste materials and mixtures thereof.

18. The process as defined in claim 1, including the further step of comminuting the solid coke product to an average particle size of less than about 150 mesh, admixing the comminuted coke product with a fuel oil in an amount of from about 1% up to about 50% by weight coke product based on the total weight of the mixture providing a liquid fuel oil slurry.

19. The process as defined in claim 8, in which the second elevated temperature ranges from about 1500° F. to about 1900° F.

20. A metallurgical coke product produced by the process as defined in claim 1.

21. A liquid fuel oil slurry comprising a mixture of a residual fuel oil and a particulated coke produced in accordance with the process as defined in claim 1, said coke product present in an amount of from about 1% up to about 50% by weight of the fuel slurry, said coke product being present in the form of suspended particles of a particle size less than about 150 mesh.

* * * * *

UNITED STATES PATENT AND TRADEMARK OFFICE

CERTIFICATE OF CORRECTION

PATENT NO. : 4,127,391

DATED : November 28, 1978

INVENTOR(S) : Edward Koppelman

It is certified that error appears in the above-identified patent and that said Letters Patent are hereby corrected as shown below:

Column 4, line 21, "were" should be --are--.
Claim 7, column 13, line 47, "cake" should be --coke--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*